United States Patent [19]

Ogura et al.

[11] Patent Number: 4,876,577

[45] Date of Patent: Oct. 24, 1989

[54] MULTI-COMPONENT PHOTORECEPTOR CARTRIDGE UNIT

[75] Inventors: Mitsuru Ogura, Nara; Kimihide Tsukamoto, Yamatokoriyama, both of Japan

[73] Assignee: Sharp Kabushiki Kaisha, Osaka, Japan

[21] Appl. No.: 251,055

[22] Filed: Sep. 26, 1988

Related U.S. Application Data

[63] Continuation of Ser. No. 945,516, Dec. 23, 1986, abandoned.

[30] Foreign Application Priority Data

Dec. 27, 1985 [JP] Japan ..... 60-297306

[51] Int. Cl.[4] ..... G03G 21/00; G03G 15/06

[52] U.S. Cl. ..... 355/315; 355/260; 271/900

[58] Field of Search ..... 355/3 R, 3 DD, 3 DR, 355/245, 260, 315; 271/306–313, 900

[56] References Cited

U.S. PATENT DOCUMENTS

| | | | |
|---|---|---|---|
| 4,386,841 | 7/1983 | Wakao et al. | 355/3 DR |
| 4,470,689 | 9/1984 | Nomura et al. | 355/3 DR X |
| 4,540,268 | 9/1985 | Toyono et al. | 355/3 DR X |
| 4,563,074 | 1/1986 | Tsutsui et al. | 355/3 DD |
| 4,593,993 | 6/1986 | Imiazumi | 355/3 R |
| 4,598,993 | 7/1986 | Mizutani et al. | 355/3 R |
| 4,609,276 | 9/1986 | Mitzutani | 355/3 DR X |
| 4,761,667 | 8/1988 | Miyai et al. | 355/3 R |

*Primary Examiner*—A. T. Grimley
*Assistant Examiner*—Ed Pipala
*Attorney, Agent, or Firm*—Birch, Stewart, Kolasch & Birch

[57] ABSTRACT

A cartridge unit for use in an image forming apparatus, in which a separating unit including a separating tape normally comparatively easily soiled by toner, is provided as one unit together with a photoreceptor drum, corona charger and cleaner unit in the cartridge unit, whereby cleaning of the separating parts at the site of the user is made unnecessary so as to achieve a maintenance-free operation.

3 Claims, 3 Drawing Sheets

MULTI-COMPONENT PHOTORECEPTOR CARTRIDGE UNIT

This application is a continuation of application Ser. No. 06/945,516 filed on Dec. 23, 1986, now abandoned.

BACKGROUND OF THE INVENTION

The present invention generally relates to an image forming apparatus, e.g., an electrophotographic copying apparatus and the like, and more particularly, to a cartridge unit which accommodates therein as one unit, a photoreceptor drum and at least a cleaner unit with the various components disposed around the photoreceptor drum, so as to be detachably mounted with respect to a main body of the image forming apparatus.

In a recent image forming apparatus such as a compact size copying apparatus or the like, it has been proposed to employ a cartridge unit arranged to be replaceable at the user's side without the necessity for calling servicing personnel even when the replacement time of components, such as a photoreceptor drum, etc., has arrived, from the viewpoint of a maintenance-free operation. By forming such a cartridge into one unit with the photoreceptor drum and a cleaner unit or the like including a used toner accommodating portion which is one of the parts required to be replaced after a predetermined period of time, there is the advantage that at the user's side, when it becomes necessary to replace those parts, the entire cartridge unit may be readily replaced by the user, without the necessity for calling servicing personnel.

Conventionally, although a cartridge unit integrally formed with the photoreceptor drum, cleaner unit or a first corona charger has been proposed, there has not been proposed a cartridge unit in which a separation unit for separating a copy paper sheet after transfer is incorporated therein as one unit. Therefore, when the photoreceptor drum has served its life, the situation may be readily adjusted to by replacing the entire cartridge unit, but in the case where a copy paper separation unit is soiled by toner, etc., it has been necessary to call servicing personnel in for cleaning. Particularly, in an image forming apparatus employing a separating tape for effecting the separation, cleaning is required periodically, since the separating tape and separating roller, etc., tend to be soiled by toner, but it has been very difficult for the user to clean such portions.

Moreover, there has been an inconvenience such that, although the positioning of the separation unit must be highly accurate owing to the relation thereof with respect to the photoreceptor drum, in the arrangement in which the photoreceptor drum is detachable as the cartridge unit, with the separation unit remaining fixed to the image forming apparatus main body, positional accuracy of the separation unit can not be sufficiently achieved.

SUMMARY OF THE INVENTION

Accordingly, an essential object of the present invention is to provide a cartridge unit for use in an image forming apparatus, in which separating parts, including a separating tape comparatively easily soiled by toner, are provided as one unit together with a photoreceptor drum, in the cartridge unit, whereby cleaning of the separating parts by the user is made unnecessary so as to achieve a maintenance-free operation.

Another object of the present invention is to provide a cartridge unit of the above described type which is simple in construction and stable in functioning, and can be readily incorporated into various image forming apparatuses at a low cost.

In accomplishing these and other objects, according to one preferred embodiment of the present invention, there is provided a cartridge unit for use in an image forming apparatus, which includes a housing, a photoreceptor drum rotatably provided in the housing, and a cleaner unit including at least a used toner container with various components sequentially disposed around the photoreceptor drum, with the housing, photoreceptor drum and cleaner unit being formed into one unit to constitute the cartridge unit which is detachable with respect to the image forming apparatus main body, and is characterized in that the separating unit which includes a separating tape for separating copy paper after image transfer from the photoreceptor drum, is also formed into one unit together with the photoreceptor drum and the cleaner unit.

By the above arrangement according to the present invention, since the copy paper separating parts are formed into one unit together with the photoreceptor drum, cleaner unit, etc., to constitute the cartridge unit, it is not required to effect the replacement for each of the photoreceptor drum and cleaner unit, nor to particularly clean the separating parts. Furthermore, it is not necessary to call servicing personnel for the work as previously described. Thus, the user is merely required to replace the entire cartridge unit when it becomes necessary to exchange the cartridge, e.g. when the number of image formation has reached a predetermined number, and can effect the work therefor simply without soiling one's hands or the interior of the image forming apparatus by toner, etc. Therefore, according to the present invention, the maintenance-free operation required for the compact copying apparatus may be advantageously realized.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
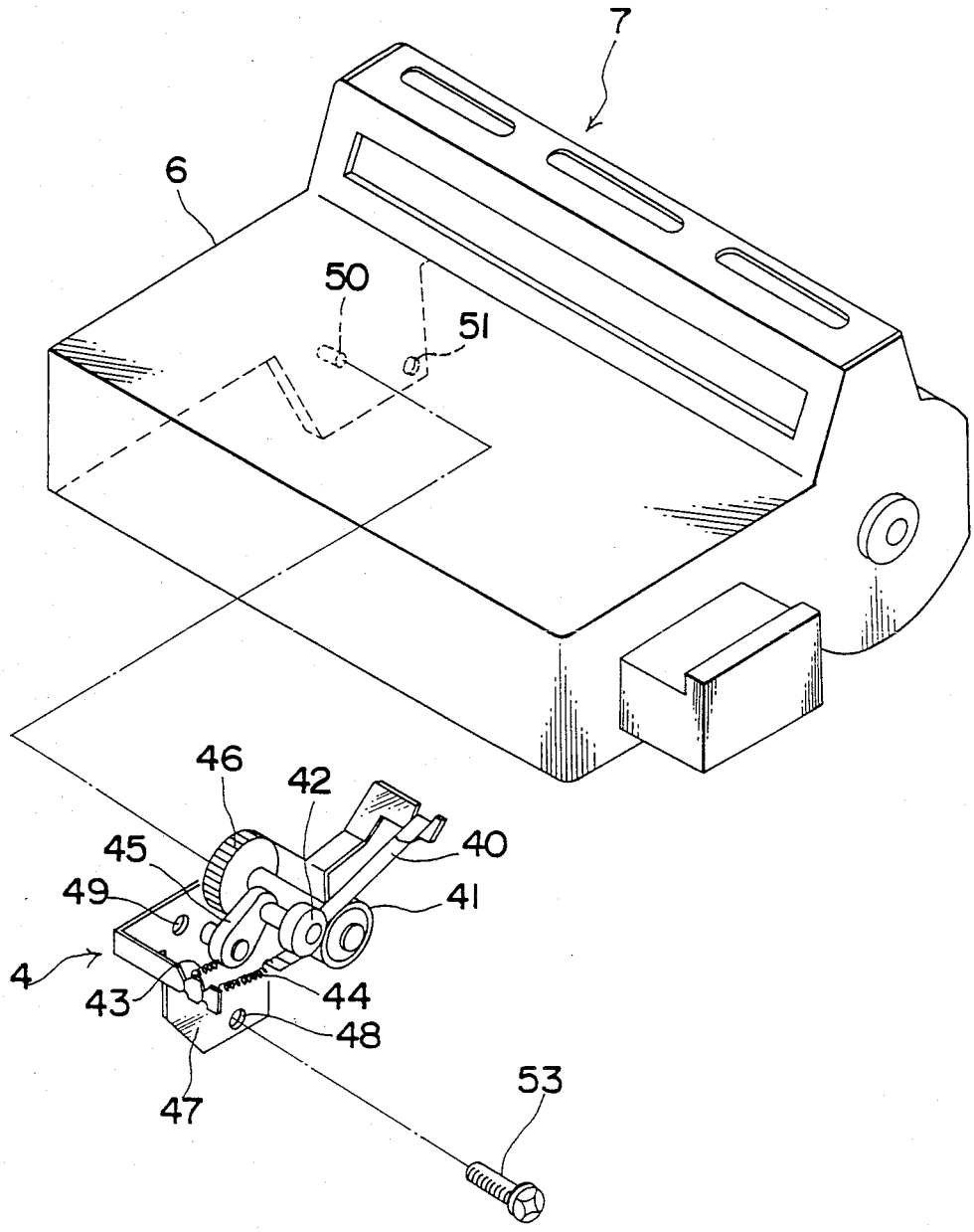
FIG. 1 is an exploded perspective view of a cartridge unit according to one preferred embodiment of the present invention for explaining mounting of a copy paper separating unit thereon.

Before the description of the present invention proceeds, it is to be noted that like parts are designated by like reference numerals throughout the accompanying drawings.

Figure 2:
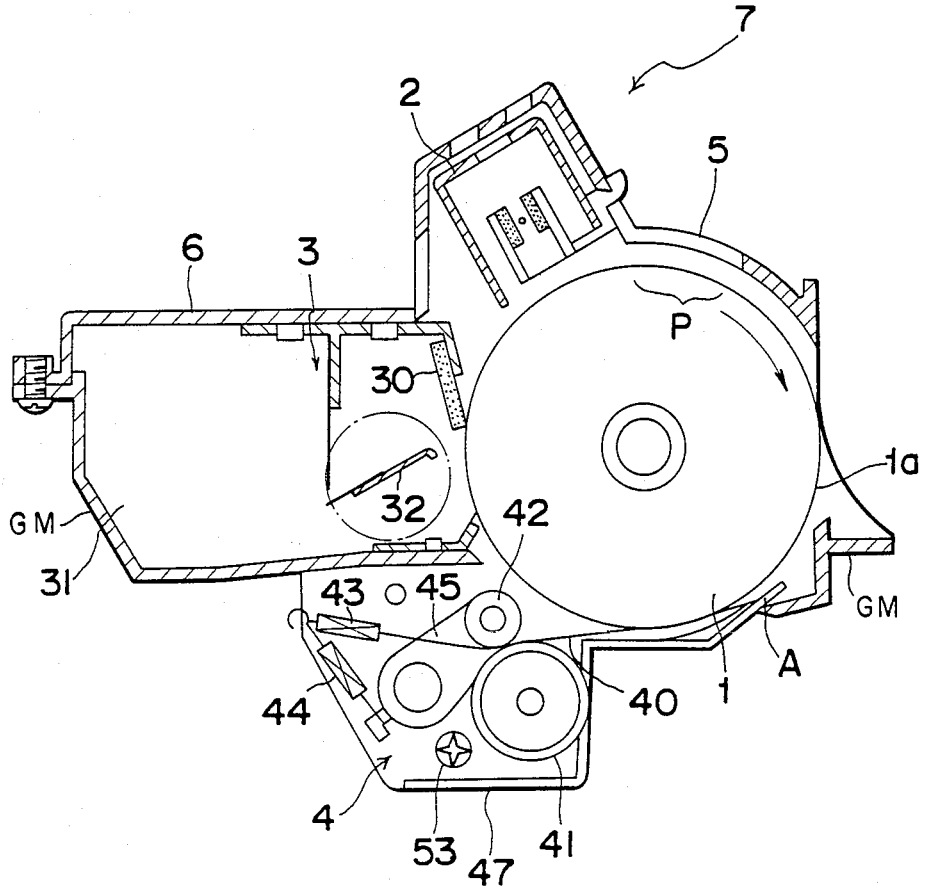
FIG. 2 is a side sectional view of the cartridge unit shown in FIG. 1.
Figure 3:
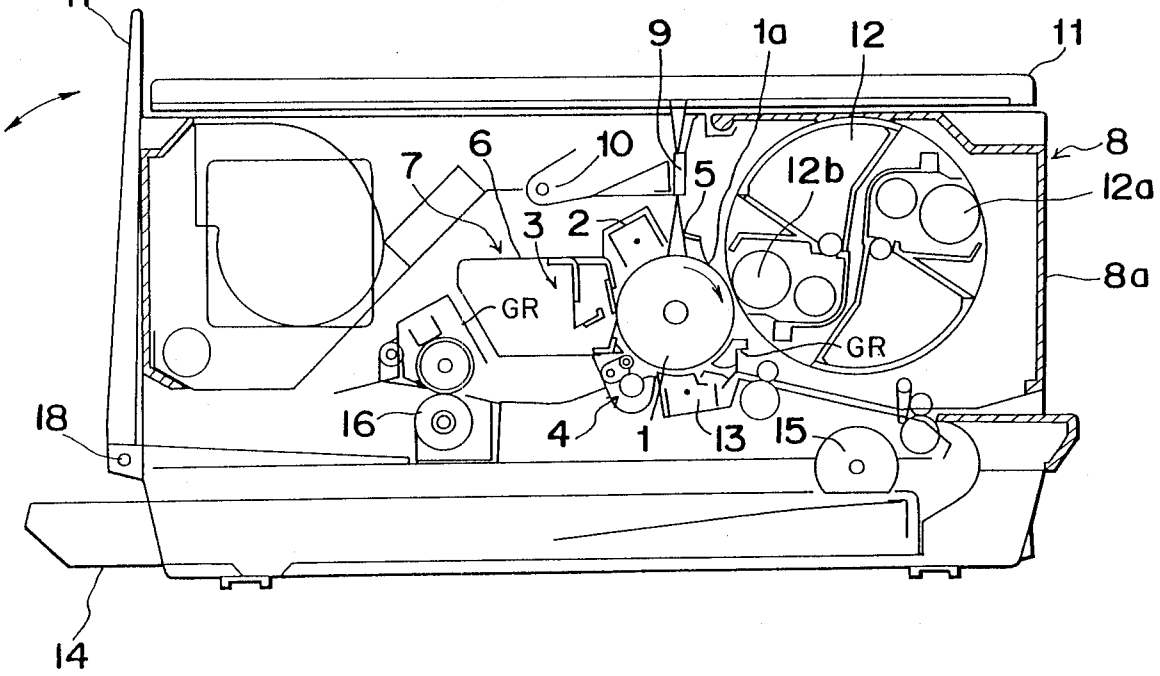
FIG. 3 is a schematic side sectional view of a copying apparatus to which the cartridge unit of FIG. 1 according to the present invention may be applied.

Referring now to the drawings, there is shown in FIG. 3 an electrophotographic copying apparatus 8 to which the cartridge unit 7 according to one preferred embodiment of the present invention may be applied. The cartridge unit 7 includes a housing 6, a photoreceptor drum 1 having a photosensitive surface 1*a* formed on its outer peripheral face rotatably mounted therein, a corona charger 2, a cleaner unit 3, a copy paper sheet separating unit 4, and an exposure opening 5 (exposure slit) sequentially disposed around the photoreceptor drum 1 within the housing 6, all of which are integrally mounted in said housing 6 to constitute the cartridge unit 7, and is arranged to be detachable with respect to a main body 8*a* of the copying apparatus 8 through a guide mechanism including guide member Gm and guide rail. More specifically, when the cartridge unit 7 is pushed forward into the apparatus main body 8*a* in a direction perpendicular to the paper face in FIG. 3, with a front panel (not shown) of the main body 8*a* opened, the cartridge unit 7 is mounted in the main body, while on the contrary, when the cartridge unit 7 is withdrawn in the opposite direction, it is disengaged from the main body 8*a*. At the upper portion of the apparatus housing 8*a*, there is provided an image transmitter 9 in a bundled configuration (referred to merely as an image transmitter hereinafter) so as to constitute an optical system together with a light source 10 provided at the left side thereof. An original document (not particularly shown) placed on a horizontally movable original document platform 11 disposed at the upper portion of the apparatus main body 8*a* is scanned by light emitted from the light source 10 as the platform 11 is displaced, and the light image of the original document is projected onto the photosensitive surface 1*a* of the photoreceptor drum 1 through the image transmitter 9. The photoreceptor drum 1 is rotated in a direction indicated by the arrow in FIGS. 2 and 3, and after having been uniformly charged by the corona charger 2, the photosensitive surface 1*a* of the photoreceptor drum 1 is subjected to exposure by the light transmitting through the exposure slit 5 so as to form thereon an electrostatic latent image of the original document. The latent image thus formed is developed into a visible image by a developing unit 12 provided at a position adjacent to the photoreceptor drum 1 and is subsequently transferred, at a position of a transfer corona charger 13, onto a copy paper sheet (not particularly shown) which is fed by a paper feeding roller 15 from a paper cassette 14 disposed at the bottom portion of the apparatus main body 8*a*. The copy paper sheet, with the image transferred from the surface 1*a* of the photoreceptor drum 1 by the transfer corona charger 13, is separated from the photoreceptor drum 1 at the position of the separating unit 4, and is fed to the position of the fixing rollers 16 for fixing the image thereon. At the left side of the apparatus main body 8*a* in FIG. 3, there is provided a paper discharge tray 17 which is pivotally connected, at its lower portion, to the main body 8*a* by a pin 18 for rotation about the pin. For effecting the copying operation, the paper discharge tray 17 is rotated counterclockwise about the pin 18 so as to be fixed at a position generally parallel to the paper discharge direction of the apparatus main body 8*a*. The developing unit 12 is provided with two developing sections 12*a* and 12*b*, either one of which may be used for development through rotation of the unit 12.

Referring particularly to FIG. 2 showing a side sectional view of the cartridge unit 7 on an enlarged scale, a rotary shaft of the photoreceptor drum 1, the first corona charger 2, the cleaner unit 3 and the separating unit 4 are mounted in the housing 6, and a portion of the housing 6 corresopnding in position to the exposing portion P of the photoreceptor drum 1 is opened to form the exposure slit 5.

The cleaner unit 3 defined in the housing 6 at the left side in FIG. 2 includes a blade 30 held in contact with the surface 1*a* of the photoreceptor drum 1 for scraping off residual toner remaining thereon, a used toner container 31, and a rotary plate 32 for feeding the used toner scraped off by the blade 30 into the container 31 through rotation.

Meanwhile, the separating unit 4 provided within the cartridge unit 7 includes a separating unit frame 47, a separating roller 41 and a pressure roller 42 rotatably mounted on the frame 47, a separating tape 40, and drive gears (not shown) for the separating roller 41, and springs 43 and 44, etc., all of which are mounted on the frame 47, fixed to the rear end portion of the housing 6, as illustrated. One end of the separating tape 40 is connected to the housing 6 at a point A, while the other end thereof is connected to a spring 43, its free end being connected to the frame 47, with the surface of the separating tape contacting the lower surface 1*a* of the photoreceptor drum 1. The spring 43 is intended to impart tension to the separating tape 40. The separating roller 41 driven by a separating roller drive gear 46 (FIG. 1) is adapted to hold a copy paper sheet between the roller 41 and the undersurface of the separating tape 40 for feeding forwardly. The pressure roller 42 contacting the separating roller 41 is intended to hold the separating tape 40 in contact with the roller 41 under pressure through a linking member 45 connected to one end of the spring 44, its free other end being connected to the frame 47.

Reference is also made to FIG. 1 for explaining mounting of the separating unit 4 as described above onto the housing 6.

As described earlier, the separating unit 4 is formed into one unit by integrally mounting the separating tape 40, separating roller 41, pressure roller 42, springs 43 and 44, link 45, and separating roller drive gear 46, etc., onto the separating unit frame 47. The frame 47 has a screw fixing hole 48 formed at its lower portion, and another positioning hole 49 formed at its upper portion. Meanwhile, at the rear portion of the housing 6 of the cartridge unit 7, a projection 50 and a screw hole 51 are formed to secure the separating unit 4. The separating unit 4 is fixed to the housing 6 by inserting the projection 50 into the positioning hole 49 formed at the upper portion of the frame 47, and by tightening a screw 53 inserted into the hole 48 in the state where the hole 48 is aligned with the screw hole 51.

By the above arrangement, according to the present invention, the cartridge unit may be constructed by forming the separating unit 4 as one unit with the photoreceptor drum 1, first corona charger 2, and cleaner unit 3 within the housing 6.

As is clear from the foregoing description, according to the above embodiment of the present invention, a perfect maintenance-free operation may be realized, since the separating parts conventionally requiring maintenance work such as cleaning, are accommodated in one unit together with the photoreceptor drum, within the cartridge. Furthermore, in the separating device adapted to effect separation of copy paper sheets by the separating tape, a plurality of complicated parts are normally required, but in the embodiment of the present invention, since such parts are formed into one unit together with the photoreceptor drum, not only is the positional accuracy for mounting improved, but efficiency for assembling is enhanced which increase productivity to a large extent.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A photoreceptor cartridge unit for use in an image forming apparatus for accommodating a photoreceptor drum and its peripheral components in said image forming apparatus, which comprises a housing, a photoreceptor drum rotatably provided in said housing, a cleaner unit including a used toner containing and a multi-component separating unit, which includes a separating unit frame and a separating tape for separating copy paper from the photoreceptor drum following image transfer, mounted on said housing of said cartridge unit, sequentially disposed around said photoreceptor drum, said housing, photoreceptor drum, cleaner unit and separating unit being formed into one single unit to constitute said cartridge unit which is detachable with respect to said image forming apparatus, said separating tape being stretched so as to freely expand and contract between said separating unit frame via a spring and said housing of said photoreceptor cartridge unit, such that proper tension on said separating tape is applied upon the fixing of said multi-component separating unit to said housing.

2. The cartridge unit of claim 1, wherein said separating unit includes said frame, said separating tape stretched on said frame and means for separating copy paper sheets from said photoreceptor drum in cooperation with said separating tape, said separating unit being formed as a single unit as a part of said cartridge unit, forming a unit within a unit, such that upon filling of said toner container and contamination of said cartridge unit, including said separating unit, said cartridge unit may be readily replaced providing a maintenance free image forming apparatus.

3. A cartridge unit as in claim 2, wherein said cartridge unit is detachable with respect to said image forming apparatus main body through a guide mechanism including guide rails and guide members.

* * * * *